United States Patent [19]

Trummer

[11] Patent Number: 4,742,903

[45] Date of Patent: May 10, 1988

[54] DEVICE FOR COIN CHECKING

[75] Inventor: Bernhard Trummer, Bern, Switzerland

[73] Assignee: Autelca AG., Gümligen, Switzerland

[21] Appl. No.: 876,078

[22] Filed: Jun. 19, 1986

[30] Foreign Application Priority Data

Jul. 26, 1985 [CH] Switzerland ..... 3254/85

[51] Int. Cl.[4] ..... G07D 5/08

[52] U.S. Cl. ..... 194/317; 194/328

[58] Field of Search ..... 194/317, 318, 319, 328

[56] References Cited

U.S. PATENT DOCUMENTS

| | | | |
|---|---|---|---|
| 3,749,220 | 7/1973 | Tabiichi et al. | 194/319 |
| 4,254,857 | 3/1981 | Levasseur et al. | 194/319 |
| 4,579,217 | 4/1986 | Rawicz-Szcerbo | 194/317 |
| 4,601,380 | 7/1986 | Dean et al. | 194/318 |

FOREIGN PATENT DOCUMENTS

| | | | |
|---|---|---|---|
| 2636922 | 2/1978 | Fed. Rep. of Germany | 194/317 |

*Primary Examiner*—F. J. Bartuska

*Attorney, Agent, or Firm*—Brady, O'Boyle & Gates

[57] ABSTRACT

The coin to be checked for several characteristics influences, partially in succession and partially simultaneously, the coils (7–12) of several oscillator tank circuits (1–6). The oscillator tank circuits (1–6) are correspondingly connected to an amplifier (14) for the formation of an oscillator, individually in succession, those circuits with simultaneously influenced coils being connected periodically in alternation to this amplifier. Thereby, successive and simultaneous, high-frequency test signals are produced which are nested in one another in accordance with the time-division multiplex principle, these test signals corresponding to the influences exerted by the coin on the oscillator tank circuit coils (7–12). These test signals, after demodulation (19) and analog-to-digital conversion (20), are compared in an evaluating unit (22) individually with criteria stored in a memory (23) for each type of coin to be accepted.

20 Claims, 3 Drawing Sheets

Fig.6
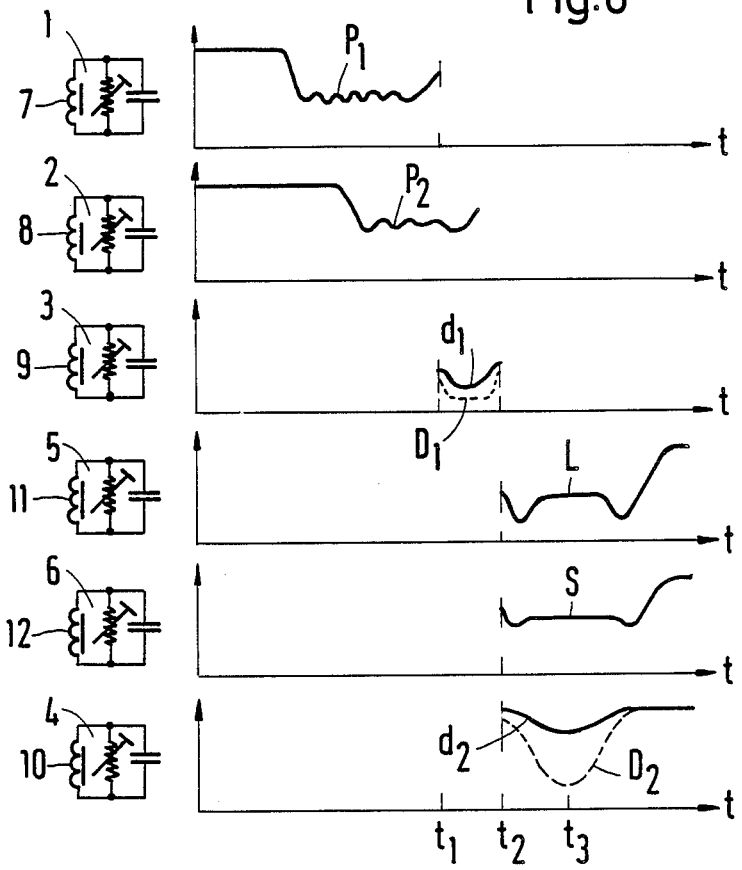
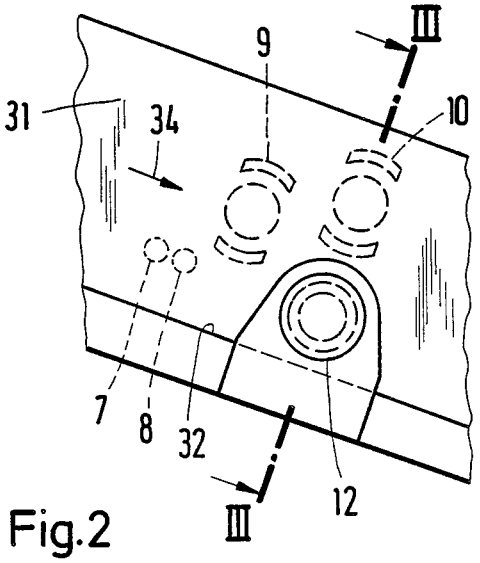
Fig.2
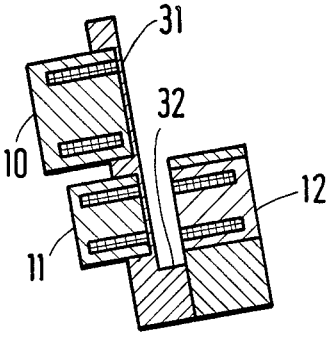
Fig. 3

Fig.4
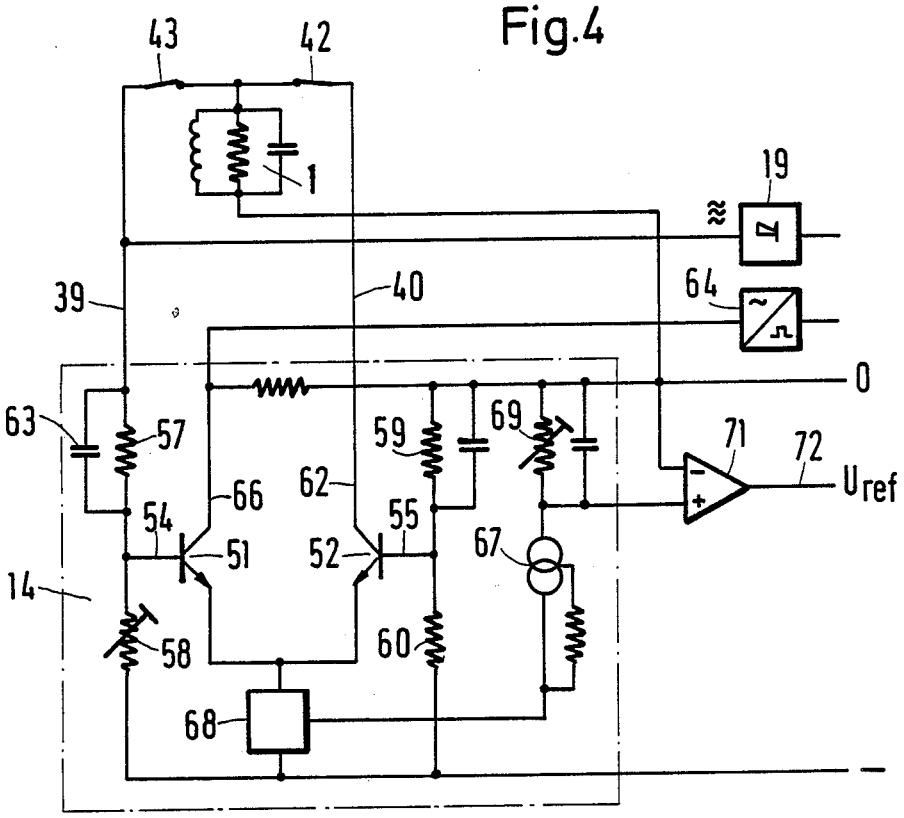
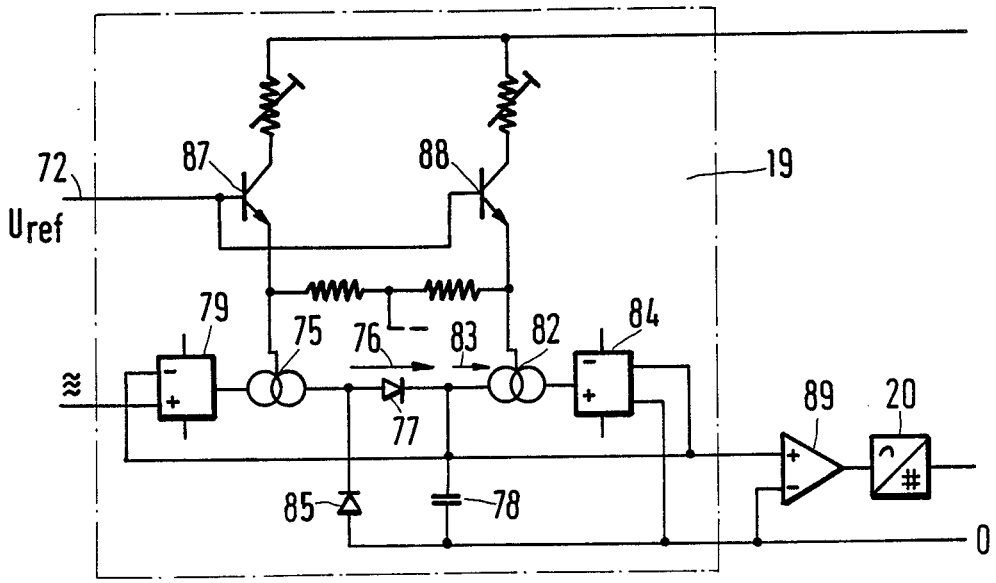
Fig. 5

DEVICE FOR COIN CHECKING

The invention relates to a device for checking coins.

BACKGROUND OF THE INVENTION

The invention, as characterized in the claims, solves the problem of providing a device of this type which makes it possible to test several coin characteristics accurately within narrow tolerances, which has a low, only short-time current consumption, occupies a small amount of space, can be designed so that it has a built-in correction of the influence of changes in the properties of its components on the test results, and requires little adjustment work during its manufacture and its operation.

SUMMARY OF THE INVENTION

The advantages attained by the invention are to be seen essentially in that all oscillators are formed with one and the same amplifier so that during production of the device and during its operation only a single amplifier needs to be tuned, and so that only the supply current of this single amplifier flows during the checking of several coin characteristics. In this connection, the duration of supply current flow can be very short in that the switching unit, after a portion of a test signal for a coin characteristic sufficient for evaluation, connects the oscillator tank circuit provided for the subsequent checking of a further coin characteristic, to the amplifier, unless evaluation of the test signal has already resulted in a coin return signal. The switching unit, in this procedure, automatically follows the chronological sequence in which the coin to be checked influences in succession various coils so that these coils can be arranged in very close mutual succession. This permits a very brief testing time and a very brief testing path of the coin guide. Also, the coils of oscillator tank circuits for checking the same or different coin properties can be arranged so that the coin to be checked affects them simultaneously, during which step the oscillator tank circuits with these coils are periodically alternatingly excited, i.e. are connected repeatedly for a short time to the amplifier by the switching unit. The feature of simultaneous influence is made possible by the fact that each oscillator tank circuit has only one coil, the coin passing by the end face of this coil. Due to these measures, it is possible, for example, with a coin speed of 0.5 m/sec to achieve a testing period of less than 100 ms with an energy consumption of 200 mWs per coin. Due to the fact that the test signals for the various coin characteristics are formed from the oscillator oscillations by one and the same demodulator with subsequent analog-to-digital converter, the changes (drift), unavoidable in the long run and having an undesirable effect on the test signals, to which properties of the components of the demodulator and analog-to-digital converter are subjected, exert the same effect on all test signals. This makes it possible to provide automatic correction in the evaluating unit so that the drift need not be taken into account when dimensioning the tolerance ranges of the testing criteria (triggering a coin return signal in the evaluating unit when exceeded or when the value falls below such tolerance range). This makes it possible to perform a very critical and yet reliable test. Other advantages also reside in an especially stable amplifier circuit for the oscillator requiring neither feedback coils nor coil taps, in conjunction with a design of the switching unit wherein, in spite of the use of semiconductor switches, the entire oscillator tank circuit voltage is present at the amplifier input; a rapidly responding, threshold-free demodulator; the way of correcting drift phenomena; a special coil arrangement for checking the embossing of the coin usable for checking, in addition to the depth of the embossing, also the embossed pattern; and a special coil arrangement and signal evaluation for checking the coin diameter, attaining a high power of resolution within a large diameter range. Additional advantages and solutions of individual tasks related to the invention can be seen from the following, detailed description of a device for coin checking in accordance with this invention. The device is distinguished, in total, by simplicity, a low, short-term current consumption, compactness, and reliable, accurate test results within narrow tolerances.

BRIEF DESCRIPTION OF THE DRAWINGS

The invention will be described in greater detail below with reference to drawings which represent merely one way of practising the invention. In the drawings:

FIG. 2 is a lateral view of a portion of the coin guide of the device,

FIG. 3 is a section along line III—III in FIG. 2,

FIG. 4 shows the wiring diagram of the amplifier of the device according to FIG. 1, FIG. 5 shows a wiring diagram of the amplitude demodulator of the device according to FIG. 1, FIG. 6 shows a timing diagram of the test signals and their component signals occurring, in part, in succession and, in part, simultaneously due to exertion of an influence by the coin being tested on various oscillator tank circuits of the device according to FIG. 1.

DESCRIPTION OF THE PREFERRED EMBODIMENT

Figure 1:
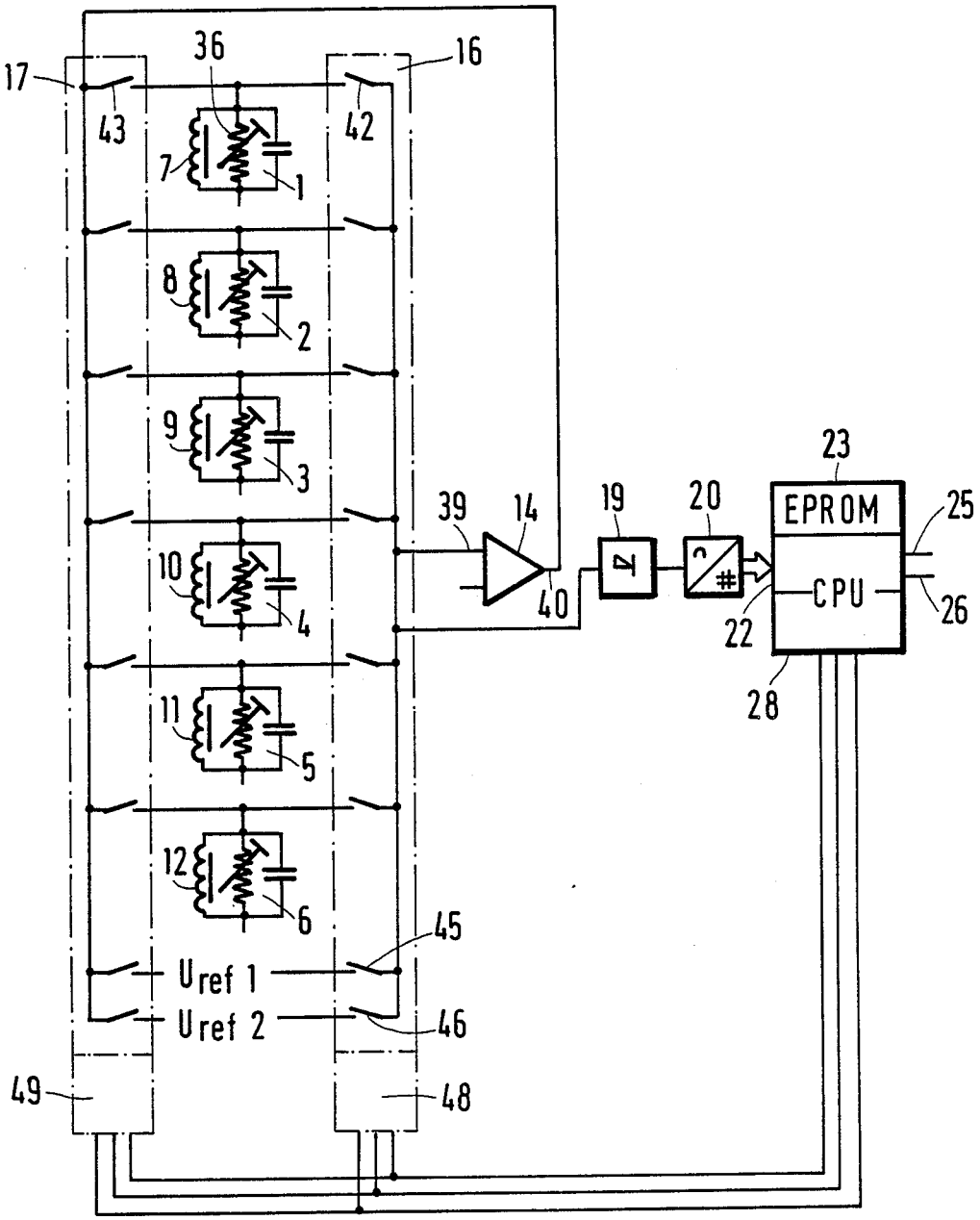
FIG. 1 shows a summary circuit diagram of a device for checking coins.

FIG. 1 illustrates a summary circuit diagram of a device for coin checking, consisting in its basic structure of the following assemblies:

six oscillator tank circuits 1–6, the oscillator circuit coils 7–12 of which are arranged at a coin guide (FIGS. 2 and 3) so that they are acted upon by the coin to be checked, for testing several coin characteristics, in part simultaneously and in part individually in succession;

an amplifier 14 (FIG. 4) and a switching unit, for example 42, 43, through which each of the oscillator tank circuits 1–6 can be connected individually to the amplifier 14 for the formation of an oscillator yielding in correspondence with the influence on the respective oscillator circuit coil, for example 7, high-frequency test signals amplitude-modulated (and also frequency-affected) by the coin to be checked;

an amplitude demodulator 19 for the high-frequency test signals, yielding an analog test signal characteristic for the effect of the coin to be checked on the respective oscillator circuit coil and thus for the respective coin property, this analog test signal being converted into a digital test signal in an analog-to-digital converter 20;

an evaluating unit 22 with read-only memory 23 wherein the digital test signals are compared with testing criteria stored in the read-only memory 23, a coin acceptance signal being triggered on a line 25 if all test signals obtained from a coin correspond to the criteria stored for one of the coins to be accepted, and a coin return signal being triggered on a line 26 if not all test signals of one and the same coin correspond to the criteria stored for one of the coins to be accepted;

a control unit 28 controlling the switching unit 16, 17 in such a way that the oscillator tank circuits 1–6 are connected to the amplifier 14 in the sequence in which their coils 7–12 are influenced by the coin to be tested, individually in succession, and oscillator tank circuits (1, 2 and, respectively, 4, 5, 6), the coils (7, 8 and, respectively, 10, 11, 12) of which are simultaneously influenced, are repeatedly connected to the amplifier 14 in alternation with one another, until the evaluating unit 22 triggers a coin acceptance or return signal on line 25 or 26, respectively.

The evaluating unit 22 and the control unit 28 are combined into a data processing device (microprocessor CPU), the read-only memory (EPROM) 23 being associated with this device.

The coin guide means according to FIGS. 2 and 3 has a steep guide surface 31 along which the coins, rolling along a roll track 32 with a gradient, slide with their entire front or rear face so that a certain, small distance is ensured between the coin and the oscillator circuit coils 7–11 arranged closely behind the guide surface 31. The oscillator tank circuits 1 through 6 are designated as follows for the testing of several coin properties: Oscillator tank circuits 1 and 2 with coils 7 and 8 for the embossing; oscillator tank circuit 3 and 4 with coils 9 and 10 for the diameter; oscillator tank circuit 5 with coil 11 for the alloy; and oscillator tank circuit 6 with coil 12 for the thickness of the coin. The oscillator circuit coils 7–12 are arranged so that the coin to be checked first acts on coils 7 and 8 simultaneously, then individually on coil 9, and subsequently simultaneously on coils 10, 11, and 12. For this purpose, the coil 10 is located at the guide surface 31 above the coil 11, and the coil 12 is located coaxially to coil 11 in opposition to the latter. In correspondence with the partially simultaneous and partially successive influencing of coils 7–12, the switching unit 16, 17 connects, during the testing of the coin characteristics, first the oscillator tank circuits 1 and 2 (coils 7 and 8) in periodic alternation (for example in each case 0.5–1 ms), then the oscillator tank circuit 3 (coil 9), and thereafter, in constant repetition successively the oscillator tank circuits 4, 5, and 6 (coils 10, 11, and 12) to the amplifier 14 in order to form an oscillator. The structural design and details of the arrangement of oscillator cirucit coils 7 through 12, the test signals occurring when the coin to be tested acts on them, the evaluation of these signals, and the triggering of the control signals for the switching unit 16, 17 will be described in greater detail further below.

In case of the absence of a coin, the oscillator tank circuits 1, 2, and 6 have a natural frequency of 247 kHz, the oscillator tank circuits 3 and 4 have a natural frequency of 230 kHz, and the oscillator tank circuit 5 has a lower natural frequency of 120 kHz at which the field of the coil 11 penetrates more deeply into the coin body, the effect of the electrical and magnetic properties of the coin alloy on the test signal being greater, and the effect of the depth of embossing being smaller. The attenuations of the oscillator tank circuits 1–6 are balanced at resistors, e.g. 36, so that the high-frequency voltage of the oscillator exhibits, with each of the oscillator tank circuits 1–6, the same amplitude in the absence of a coin, for example peak-to-peak value 2.5 V.

In order to avoid feedback coils or coil taps and a correspondingly expensive switching unit, the amplifier 14 is a noninverting amplifier having the gain of one. The switching unit 16, 17 includes for each of the oscillator tank circuits 1–6 two semiconductor switches that can be activated together, one of these semiconductor switches being able to connect the input 39 and the other of these semiconductor switches being able to connect the output 40 of the amplifier 14 with each of the oscillator tank circuits 1–6 individually. For example, the oscillator tank circuit 1 can be connected by means of the semiconductor switch 42 to the amplifier input 39 and by means of the semiconductor switch 43 to the amplifier output 40. For the purpose of utilizing integrated components, these semiconductor switches, for example 42 and 43, associated with respectively one of the oscillator tank circuits 1–6, as well as the semiconductor switches 45 and 46 mentioned further below, are parts of two analog switches 16 and 17 of the type conventional for the time-division multiplex method of the communication technology, the logic control system of which is denoted by 48 and 49, respectively. The use of two separate switches, for instance 42 and 43, has the following reason: With utilization of a single semiconductor switch, the amplifier input voltage would not be equal to the oscillator tank circuit voltage but rather would be affected by the drop in forward voltage at this switch, dependent on temperature and fluctuating because of drift phenomena. Thereby the stability (especially amplitude stability) of the oscillator would be impaired. When using the two semiconductor switches, the amplifier input voltage, however, is practically exactly identical to the oscillator tank circuit voltage, for the drop in forward voltage at the particular switch, e.g. 42, of these two semiconductor switches which connects the oscillator tank circuit, e.g. 1, to the amplifier input 39, is negligible due to the very weak amplifier input current. In this connection, in spite of the inconstant forward resistance of the semiconductor switches, a high stability of the oscillator is attained.

FIG. 4 shows the amplifier 14 in the condition of the analog switches 16, 17 wherein it forms an oscillator with the oscillator tank circuit 1. The amplifier 14 is a stabilized differential amplifier with a first and second transistor 51 and 52 in emitter coupling mode. Identical component voltages of two DC voltage dividers 57, 58 and 59, 60 are applied to the inputs 54 and 55 of this amplifier circuit. Based on the output 62 (collector of second transistor 52), 54 (base of the first transistor 51) is the noninverting input. The oscillator tank circuit voltage is superposed on this input, in that the oscillator tank circuit 1 is connected to this input 54 by means of the semiconductor switch 43 and a capacitor 63 bridging the resistor 57. The output 62 is likewise connected to the oscillator tank circuit 1 by means of the semiconductor switch 42. A pulse shaper 64 is connected, so as to exert a minimum of influence on the oscillator, to the other output 66 (collector of first transistor 51), this pulse shaper yielding pulses having the frequency of the oscillator oscillations and feeding them to the evaluating unit 22 which latter utilizes these pulses as an additional test signal, especially, for example, when checking the alloy of the coin. A constant current source 67 in conunction with a current mirror* 68, connected between the coupled emitters of transistors 51 and 52 and a fixed negative reference potential (for example −5 V), serve for stabilizing the amplifier. A resistor 69 connected in series with the constant current source 67 yields a constant (negative) reference voltage which is amplified and inverted by an amplifier 71, the voltage $U_{ref}$ at the output 72 of this amplifier 71 being practically load-independent.

*German "Stromspiegel"

The amplitude demodulator 19 comprises, according to FIG. 5, a first constant current source 75 supplying a charging current, represented by an arrow 76, of, for example, 0.33 mA in the forward direction of a diode 77 to a capacitor 78. The constant current source 75 is controlled by a comparator 79 so that the charging current 76 flows whenever the instantaneous value of the high-frequency voltage is larger than the capacitor voltage. A second constant current source 82 yields a discharging current, indicated by an arrow 83, of, for example, 0.004 mA directly to capacitor 78. The second constant current source 82 is controlled by a second comparator 84 so that the discharging current 83 flows whenever the capacitor voltage has the polarity corresponding to the charging current 76. Since the discharging current 83 is very much weaker than the charging current 76, the comparator 84 can also be omitted, so that the discharging current 83 flows continuously. If the instantaneous value of the high-frequency voltage is smaller than the voltage at capacitor 78, the current of the constant current source 75, in this case directed oppositely to the direction of arrow 76, flows through the diode 85. The currents 76 and 83 of the constant current sources 75 and 82 are affected, with the aid of two transistors 87 and 88, by possible changes in the reference voltage at the output line 72 of amplifier 71 (FIG. 4) in such a way that in case of a change in high-frequency voltage of the oscillator formed therewith and with respectively one of the oscillator tank circuits 1–6, caused by a change in the supply current of amplifier 14, the charging current 76 (and with comparator 84 also the discharging current 83) of capacitor 78 in the demodulator 19 is changed in the same way; consequently, this change in high-frequency voltage has no effect on the analog signal. This makes it possible to utilize test criteria of narrow tolerance. The output signal (voltage of capacitor 78) of the demodulator 19 is amplified in an amplifier 89 and converted, in the analog-to-digital converter 20, into a corresponding digital signal.

For correcting the effects of gradual changes (drift) of those properties of components of the device that influence the test signals, the semiconductor switches 45 and 46 (FIG. 1) are temporarily closed in succession prior to coin checking (directly after a coin detector has responded). Thereby, a first voltage $U_{ref1}$ and thereafter a second voltage $U_{ref\,2}$ is applied to the input of the amplitude demodulator 19. These voltages are obtained from the voltage $U_{ref}$ at the output line of amplifier 71 (FIG. 4), by means of one or two voltage dividers, not shown, and are dimensioned so that $U_{ref1}$ leads to a first digital signal in a lowermost portion of the signal range of the analog-to-digital converter 20, and $U_{ref2}$ leads to a second digital signal in an uppermost portion of the signal zone of the analog-to-digital converter 20. For this purpose, $U_{ref2}$ is somewhat smaller than the oscillator amplitude in case of an oscillator tank circuit not affected by a coin, and $U_{ref\,1}$ is lower in its order of magnitude than $U_{ref\,2}$. The evaluating unit 22 (data processing system, microprocessor CPU), not shown in detail, has a subtracter, a divider, as well as an adder and a multiplier, and the memory 23 (EPROM) contains a first desired value for the first of these two digital signals, and a second desired value for the second one of these two digital signals. The subtracter forms the difference between the value of the first signal and the first desired value. The divider forms the quotient from the value of the second signal and the second desired value. Before the test signals are compared with the stored test signal criteria during the subsequent coin checking operation, each test signal is corrected by the adder by addition of the difference, and by the multiplier by multiplying with the quotient. Thereby, changes (drift) in the properties of components of the demodulator 19 and, in particular, the analog-to-digital converter 20 are compensated for in such a way that it is possible to work with very narrow-tolerance testing criteria. The first of these corrections corrects a shift in the digital values; the second correction corrects any change of the analog-to-digital region of the analog-to-digital converter 20.

Coils 7 and 8 for checking the embossing of the coin are pot core coils, the end faces of their pot cores being substantially smaller than the surface of the smallest coin to be accepted. The coils are arranged at such a spacing from the roll track 32 of the coin guide and with such a mutual distance in the travel direction 34 of the coin (FIG. 7) in succession that they are simultaneously acted upon by all coins to be accepted during a time period adequate for the generation of a test signal that can be evaluated. Since the oscillator tank circuits 1 and 2 with coils 7 and 8 are connected in periodic alternation to the amplifier 14 for the respective formation of an oscillator, the test signal for the embossing of the coin consists of two component signals $P_1$ and $P_2$ (FIG. 6), nested in each other as in the time-division multiplex method, of which $P_1$ is based on an effect on coil 7 and $P_2$ is based on an effect on coil 8. On account of the fact that the coils 7 and 8 are influenced, in this process, by different, small area sections (different circular-ring sectors) of the coin surface, the test signal $P_1$, $P_2$ contains substantially more information regarding the embossing than a test signal produced in the usual way by influencing a single coil. As testing criteria for the depth of embossing of the coin, the memory 23 contains, for each coin to be accepted, the limits of the area between which lie the signal maxima and minima. The evaluating unit 22 examines whether the range in which the minima and maxima of the test signal components $P_1$ and $P_2$ are located corresponds to one of the areas stored as criteria respectively for one of the coins to be accepted. If this is so, then the coin being tested exhibits the embossing depth of this coin to be accepted.

The larger information content of the test signal $P_1$, $P_2$ obtained with the two coils 7 and 8, characteristic for the embossing, also makes it possible to store criteria of the coins to be accepted typical for the embossed pattern (written and/or numerical and picture embossing), and utilize these criteria for examination, for example additionally to the embossing depth. These criteria must be stored for both sides of each coin, because they are different for the two sides of the coin and one cannot foretell which coin side faces, during testing, the coils 7 and 8. In this connection, it may be advantageous to locate the coils 7 and 8 at differing spacings from the roll track 32 of the coin guide unit.

The coils 9 and 10 for testing the coin diameter have pot cores, the diameters of which are substantially larger than the diameter of coils 7 and 8. Two mutually facing segments are cut out from the pot cores of coils 9 and 10, in order to reduce their dimension in the coin travel direction 34 and thus the duration of their exposure and the length of the measuring path at the coin guide. These coils 9 and 10 are arranged in succession in the coin travel direction 34 so that the highest point of the pole core of coil 9 and the lowest point of the pole core of coil 10 have the same distance from the roll track 32 of the coin guide means. Thus, the testing of the coin diameter is conducted in two diameter ranges that partially overlap each other; as compared with the influence on only one coil, this results in substantially more differentiated test signals in a larger diameter range, permitting test criteria of a narrower tolerance for the testing of the diameter. In this connection, the test signal consists of two successive component signals $d_1$ and $d_2$ for coins in a lower area of the diameter range, and, respectively, $D_1$ and $D_2$ for coins in an upper area of the diameter range, $d_1$ and $D_1$, respectively, being based on an influence being exerted on coil 9, and $d_2$ and $D_2$, respectively, being based on influence exerted on coil 10. With a coin in the lower diameter sector, $d_1$ has a pronounced minimum having a clear relationship to the coin diameter (great steepness of the signal value as a function of the diameter of the coin), whereas $d_2$ possesses a much less pronounced minimum with a small information content (shallow steepness of the signal value as a function of the diameter of the coin). The minimum of $d_1$ is evaluated for testing. With a coin in the upper diameter sector, $D_1$ has a wide range of a minimum only insubstantially affected by the coin diameter, whereas $D_2$ has a pronounced minimum much more strongly influenced by the coin diameter. The minimum of $D_2$ is evaluated for testing. The memory 25 contains for each of the coins to be accepted, the diameter of which lies in the lower diameter sector, the criteria for the minimum of the first component signal $d_1$, and for each of the coins to be accepted, the diameter of which lies in the upper diameter sector, the criteria for the minimum of the second component signal $D_2$.

The evaluating unit 22 determines the minima of these test signals by differentiating them. Criteria for the coin diameter are, for each of the coins to be accepted, an upper limit and a lower limit of the minimum of the first and, respectively, second component signal. If the first and, respectively, second component signal $d_1$ and, respectively, $D_2$ of the coin to be checked lies between the limits stored for one of the coins to be accepted, then the coin has the diameter of this coin to be accepted.

The coil 11 provided for testing the coin alloy and the coil 12 provided for testing the coin thickness are pot core coils, the pot core diameters of which are dimensioned in such a way, and which coils are located at such a distance from the roll track 32, that they are influenced in their entire pole region even by that one of the coins to be accepted which has the smallest diameter, for a time period sufficient to produce a test signal that can be evaluated. The distance of coil 12 from the guide surface 31 of the coin track is only little larger than the thickness of the thickest coin to be accepted. Thereby a maximally large influence of the coin thickness on the amplitude (and frequency) of the oscillations of the oscillator tank circuit 6 is attained with coil 12, at the time this circuit forms an oscillator together with the amplifier 14.

The test signal L for the alloy of the coin metal, obtained when coil 11 is affected by the coin to be tested, has a constant signal portion between two minima. The memory 23 contains the criteria for each of the coins to be accepted with respect to this signal portion. One of these two minima is produced once the edge of the coin enters the field of coil 11, and the other one is formed upon the exit of the coin edge from the field of coil 11, a coin edge zone acting as a conductor moving in the high-frequency field of the coil 11 (limited in its field). If the coin has a marginal zone of one alloy and a central region of another alloy, then this will affect the two minima and the constant, middle signal portion. For this reason, these minima and this middle signal portion can be utilized as differentiating features of different coins of this type and of coins made up of only one alloy, as well as of coins having a central hole, in that corresponding criteria are stored in the memory 23 and compared with these portions of the signal L. For this purpose, the oscillator tank circuit 5 must be excited, i.e. connected to amplifier 14, not only during the influencing of the entire pole region of its coil 11 by the coin to be tested, but also when the coin edge has reached the pole region or leaves the pole region. In contrast thereto, it is enough for the oscillator tank circuit 3 to be excited only in a region of maximum influence on its coil 9. It would also be adequate to excite the oscillator tank circuit 4 only in a region of maximum influence on its coil 10 and to excite simultaneously the oscillator tank circuit 6.

The test signal S for the thickness of the coin, obtained during influencing of coil 12 by the coin to be tested, likewise has a constant signal portion between two minima; for each of the coins to be accepted, the memory 23 contains the criteria in connection with this signal portion with which the latter is compared during evaluation of the signal S. The two minima here have no significance.

The aforementioned minima occur, for the reason mentioned above, also in case of signals $P_1$ and $P_2$ but become significant only for a very short time due to the small ratio of the diameter of coils 7 and 8 with respect to the coin diameter (for example 4 mm) and with respect to the coin speed (for example 0.5 m/sec); however, these minima could be additionally utilized during testing of the embossing. The oscillator tank circuits 3 and 4, when the coin edge enters the field of coil 9 or 10 and exits again therefrom, are not as yet, or no longer excited, as will be described further below in connection with the further switching of the analog switches 16 and 17 from oscillator tank circuits 1 and 2 to the oscillator tank circuit 3, and from oscillator tank circuit 3 to the oscillator tank circuits 4, 5, and 6. The minimum of $d_1$ and, respectively, of $D_2$, governing for signal evaluation, and optionally the minima of, for example, L, are determined by the evaluating unit 22 by differentiation of these signals. The middle, constant portion of signals L and S is located in a zone having in its center the minimum of $D_2$ (instant $t_3$). The magnitude exhibited by these signals in this instant (or shortly thereafter) is evaluated accordingly in the evaluating unit 22.

Criteria for the alloy and for the thickness of the coin are an upper limit and a lower limit of the constant, central signal portion of L and S, respectively (and optionally the minima of signal L). If the respective signal portion lies between the limits stored for the alloy and, respectively, thickness of one of the coins to be accepted, then the coin to be tested has the alloy and, respectively, thickness of this coin to be accepted.

The above signals $P_1$, $P_2$, $D_2$, L and S consist of short signal portions nested in one another as in case of the time-division multiplex system since, for the simultaneous production of the component signals $P_1$ and $P_2$ for the embossing, of the component signal $D_2$ for the diameter, of the signal L for the alloy, and of the signal S for the thickness of the coin, the oscillator tank circuits 1 and 2 and, respectively, 4, 5, and 6 with the coils 7 and 8 and, respectively, 10, 11, and 12 are excited, in continuously successive repetition, respectively for a short time, by connection to the amplifier 14. The correlation of these nested-together signal portions to the signals causes no particular difficulties in the evaluating unit 22, because the same evaluating unit 22 (of the microprocessor CPU) also controls the control unit 28 for the analog switches 16 and 17, by means of which the oscillator tank circuits 1 and 2 and, respectively, 4, 5, and 6 are respectively connected to the amplifier 14 and thus excited.

The continued switching of the device from one testing procedure to the subsequent testing procedure and/or to the subsequent, simultaneous testing procedures, is respectively triggered by the coin to be tested proper. As soon as a portion of the test signal (component signal) $P_1$ of the oscillator tank circuit 1 (coil 7), sufficient for evaluation, is present (this being the case at instant $t_1$ when the rising flank of the component signal $P_1$ indicates that no additional information is to be expected), the evaluating unit 22 triggers (by means of the control unit 28) a signal to the logic control circuit 48 and 49 of the analog switches 16 and 17, by means of which their semiconductor switches, associated with the oscillator tank circuit 3 with coil 9, are closed so that the amplifier 14 forms an oscillator with the oscillator tank circuit 3. The oscillator circuit coil 9 of the latter is now influenced by the coin to be tested. Thereby, then, the first component signal $d_1$ or $D_1$ of the test signal for the coin diameter is produced. As soon as this component signal rises after a minimum, i.e. at instant $t_2$, it contains all of the required information, and at this point in time the evaluating unit 22 causes the oscillator tank circuits 4, 5, and 6 to be continuously connected repeatedly and each individually to the amplifier 14 in order to form an oscillator. The coin affects simultaneously the coils 10, 11, and 12 of these oscillator tank circuits 4, 5, and 6. During this process, there are produced, by influencing the coil 10, the second component signal $d_2$ and $D_2$, respectively, for testing the diameter; by influencing the coil 11, the signal L for testing the alloy; and by influencing the coil 12, the signal S for testing the thickness of the coin.

The device could also be designed so that the analog switches 16 and 17 connect the oscillator tank circuits 1 through 6 to the amplifier 14 in a cycle that is constantly repeated during the coin testing, for the formation of an oscillator. This, however, leads to a longer testing period—just as a likewise possible succession of the testing steps in accordance with a fixed timing program presupposing a specific coin speed.

As soon as the evaluating unit 22 has determined that a test signal or component signal of a test signal does not correspond to any of the criteria stored for the respective coin characteristic of the coins to be accepted, or several such signals (obtained from one and the same coin) do not correspond to the criteria stored for the respective characteristics of one and the same coin to be accepted, the evaluating unit triggers the coin return signal at line 26. In case all test signals obtained for th various coin characteristics correspond to the criteria stored for these characteristics of one and the same, acceptable coin, the evaluating unit 22 triggers the coin aceptance signal at line 25. After a coin acceptance or coin return signal, the device again assumes its rest condition. In case of a coin return signal at the instant $t_1$ or $t_2$, a control signal for continued switching to the subsequent test procedure or subsequent test procedures is not transmitted.

Since each coin to be tested affects the amplitude as well as the frequency of the oscillator oscillations, the device can also be designed so that the frequency curve determines the test signals. Also, the embodiment can be expanded so that, when testing at least one of the coin characteristics, for example the alloy, a test is conducted whether the frequency of the oscillator oscillations, influenced by the coin, corresponds to criteria stored therefor.

The design of the coils 8 through 12, the arrangement of coils 8 and 9, as well as the arrangement of coils 9 and 10 with respect to each other, the test signals, their evaluation, and the criteria utilized in this connection, are usable analogously also without the time-division multiplex principle.

I claim:

1. Device for coin checking, characterized by a coin guide (31, 32) for the coins to be tested;

a plurality of oscillator tank circuits (1–6) each having a sensing coil (7–12);

said sensing coils (7–12) of said tank circuits (1–6) are shaped and arranged along said guide (31–32), so that different sensing coils are sequentially influenced in dependence of different characteristics of the coin to be tested, when it travels along said guide (31, 32);

an amplifier (14);

a switching unit (16, 17), by means of which each of the plurality of oscillator tank circuits (1–6) can be connected individually to said amplifier (14) for the formation of an oscillator;

a control unit (28) controlling said switching unit (16, 17) for sequentially connecting said tank circuits (1–6) to said amplifier (14);

testing means (19) responsive to the oscillator oscillations which (19) yields test signals (P1, P2, d1, d2, L, S) for different coin characteristics, corresponding to the influence exerted by the coin to be tested on the sensing coil (7–12) of the respective oscillator tank circuit of said plurality of oscillator tank circuits (1–6);

a memory (23) in which criteria are stored for each of the test signals as obtained with the coin types to be accepted;

and an evaluating unit (22) connected to said testing means (19) and said memory (23) for comparing these test signals with these criteria stored in said memory (23), and delivering a coin acceptance signal, in case all test signals obtained for the various coin characteristics of one and the same coin to be tested, correspond to the criteria stored for these characteristics of one and the same acceptable coin.

2. Device according to claim 1, characterized in that the attenuations of the oscillator tank circuits (1–6) are balanced so that the oscillator tank circuit voltage, in the condition of individual connection to the amplifier (14) and unexposed to a coin, is the same for all oscillator tank circuits (1–6).

3. Device according to claim 1, characterized in that first and second, stablilized DC voltages ($U_{ref}1$ and $U_{ref}2$) can be applied individually in succession to the input of the testing means (19) by means of switching units (45, 46) that can be acted upon by a coin presence signal prior to testing of a coin, and that these voltages are dimensioned so that the first of these voltages produces, at the input of the evaluating unit (22), a first signal, the value of which lies at the lower limit of the range of values of the test signals of coins to be accepted occurring at this input, and the second one of these voltages producing a second signal lying closely below the upper limit of this range; and that the evaluating unit (22) forms the difference from the value of the first signal and a first desired value signal associated therewith and the quotient from the value of the second signal and a second desired value signal associated therewith, and corrects each test signal by addition of the difference and multiplication with the quotient.

4. Device according to claim 1, characterized in that the switching unit (16, 17) for each (for example, 1) of the oscillator tank circuits (1–6) exhibits two semiconductor switches (e.g. 42, 43) controllable together by the evaluating unit (22), one of said semiconductor switches (42) adapted to connect the input (39) and the other of said semiconductor switches (43) adapted to connect the output of the amplifier (14) to the respective oscillator tank circuit (for example, 1); and that the amplifier (14) is a noninverting amplifier having a gain of one.

5. Device according to claim 4, characterized in that the amplifier is a differential amplifier with transistors (51, 52) having inputs (54, 55) and an output (62), coincident DC voltages being applied to the inputs (54, 55) thereof; that the DC voltage is superposed by the oscillator tank circuit voltage at the input (54) that is noninverting with respect to the output (62); and that the DC current flowing through the transistors (51, 52) is stabilized.

6. Device according to one of claims 1 or 5, in which said testing means (19) includes an amplitude demodulator (19) for the oscillator oscillations, characterized in that a constant charging current (76) of a capacitor (78) yielding the demodulated signal in said amplitude demodulator is flowing when the instantaneous value of the oscillator voltage is higher than the capacitor voltage, and that, when the polarity of the capacitor voltage corresponds to the charging current direction (76), there flows a substantially weaker, constant discharging current (83).

7. Device according to claim 1, in which said plurality of oscillator tank circuits (1–6) include a group of at least two oscillator tank circuits (1, 2) for checking the coin embossing, each of the at least two oscillator tank circuits (1, 2) of said group having a coil (7, 8), the coils (7, 8) of the at least two oscillator tank circuits (1, 2) being arranged at such a distance that their fields can be influenced simultaneously by each of the coins to be accepted, each coil (7, 8) of the at least two oscillator tank circuits (1, 2) having a pole area substantially smaller than the surface area of the smallest of coins to be accepted, and the oscillator tank circuits (1,2) of said group, during the coin testing operation, cyclically alternately connected to said amplifier (14).

8. Device according to claim 7, characterized in that the evaluating unit (22) compares the test signal ($P_1$, $P_2$), obtained on account of the influence exerted on the coils (7, 8) provided for checking the embossing of the coin, with criteria characteristic for the pictorial and, respectively, numerical embossing, these criteria being stored in the memory (23) for coins of the type to be accepted, both for coins facing these coils (7, 8) with their front side and for coins facing these coils (7, 8) with their rear side.

9. Device according to claim 1, characterized in that the evaluating unit comprises at ast one differentiating unit for determining the minimum of test signals, and that, as criteria for these minima, the limits are stored of regions between which these minima are located in case of a coin to be accepted.

10. Device according to claim 1, in which said guide (31, 32) includes a track (32) along which the coins roll, said plurality of oscillator tank circuits (1–6) include a group of at least two oscillator tank circuits (3, 4) for testing the coin diameter, each of the oscillator tank circuits (3, 4) of said group having a coil (9, 10), the coils (9, 10) of the oscillator tank circuits (3, 4) of said group being arranged along said track (32) in succession in the coin travel direction (34) at such spacings from said track (32) that each of the coins to be accepted affects one of the coils only in a portion of its pole area essential to the formation of the test signal and affects the other coil or coils either only to a minor extent or within the entire pole area.

11. Device according to claim 1, in which said plurality of oscillator tank circuits (1–6) include a first oscillator tank circuit (5) for testing the coin alloy having a coil (11), said coil (11) of said first oscillator tank circuit (5) having a pole area which is smaller than the surface area of the smallest of coins to be accepted, said first oscillator tank circuit (5) being connected to said amplifier (14) when only a marginal zone of a coin to be tested is exposed to the coil (11) thereof and hence only a part of the pole area is affected by the coin as well as at least during exposure of the central zone of the coin to be tested to the coil (11) thereof and hence during affection of the whole pole area by the coin, the test signal (L) of the first oscillator tank circuit (5) having a minimum value when only a marginal zone of a coin to be tested is exposed to the coil (11) of said first oscillator tank circuit (5) and a constant value during the exposure of the entire pole area of the coil (11) thereof; and for distinguishing coins of uniform alloy from coins having a marginal zone of one alloy and a central zone of another alloy, and coins having a central hole, said memory (23) contains stored therein, as the criteria, limits between which the minima lie and limits between which lies the constant value, for each coin to be accepted.

12. Device according to claim 1, in which said plurality of oscillator tank circuits (1–6) include at least one group of at least two oscillator tank circuits (1,2; 4, 5, 6) which are influenced by the coin to be tested simultaneously, and at least one further oscillator tank circuit (3); said at least one group of at least two oscillator tank circuits (1, 2) and said further oscillator tank circuit (3) are influenced by the coin to be tested in succession, and during the coin testing operation, are connected to said amplifier (14) in the chronological sequence of their exposure to the coin to be tested, and said at least two oscillator tank circuits (1, 2) of said at least one group are connected to said amplifier (14) in cyclic repetition by said switching unit (16, 17).

13. Device according to claim 12, in which said coin guide has a roll track (32) and a steep guide surface (31) along which the coins, rolling along said roll track (32), slide with their entire front or rear side surface, at least two oscillator tank circuits of said at least one group (1, 2; 4, 5, 6) and at least one of said at least one further oscillator tank circuit (3) including a coil (7–12) each, the coils (7, 8; 10–12) of the oscillator tank circuits (1, 2; 4, 5, 6) of said at least one group on the one hand and the coil (9) of said further oscillator tank circuit (3) on the other hand being connected at said coin guide (FIGS. 2, 3) succeeding one another in the coin travel direction (34), two of the coils (11, 12) of the oscillator tank circuits (1, 2; 4, 5, 6) of said at least one group being arranged in mutual opposition on said roll track (32), one coil (11) of said two coils connected closely behind said steep guide surface (31), and the other coil (12) of said two coils connected at a spacing from the guide surface (31) that is slightly larger than the thickness of the thickest coins to be accepted.

14. Device according to claim 1, in which said plurality of oscillator tank circuits (1–6), during the coin testing operation, are connected in continuous cyclic repetition to said amplifier (14).

15. Device according to claim 1, including a control unit (28) connected to control said switching unit (16, 17), said control unit (28) connected for control by said evaluating unit (22) in such a way that, after at least one evaluable portion of the test signal ($P_1$; $d_1$ or $D_1$) of an oscillator tank circuit (1; 3) exposed to the coin being tested, the subsequently affectable oscillator tank circuit (3) is connected to the amplifier (14).

16. Device according to claim 12, in which at least one group of at least two oscillator tank circuits (4, 5, 6) is influenced by the coin to be tested subsequent to said further oscillator tank circuit (3), a control unit (28) connected to control said switching unit (16, 17), said control unit (28) connected for control by said evaluating unit (22) in such a way that, after at least one evaluable portion of the test signal of said further oscillator tank circuit (3) exposed to the coin being tested, the at least two oscillator tank circuits (4, 5, 6) of said group are connected to said amplifier in cyclic repetition.

17. Device according to claim 12, in which said further oscillator tank circuit (3) is influenced by the coin to be tested subsequent to said group (1, 2), a control unit (28) connected to control said switching unit (16, 17), said control unit (28) connected for control by said evaluating unit (22) in such a way that, after at least one evaluable portion of the test signal of each of said at least two oscillator tank circuits (1, 2) of said group exposed to the coin being tested, the subsequently affectable further oscillator tank circuit (3) is connected to said amplifier (14).

18. Device according to claim 1, in which said control unit (28) and said evaluating unit (22) are combined in a data processing unit (CPU).

19. Device according to claim 1, in which said switching unit (16, 17) is connected for control by said control unit (28) in such a way that the switching operation is stopped if the evaluation of at least one evaluable portion of the test signal of an oscillator tank circuit exposed to the coin being tested is already sufficient for a coin return signal.

20. Device according to claim 1, in which said switching unit (16, 17) is connected for control by said control unit (28) in such a way that the switching operation is stopped if the evaluation of at least one evaluable portion of each of two subsequent test signals is sufficient for a coin return signal.

* * * * *